US012454954B2

(12) United States Patent
Kim et al.

(10) Patent No.: US 12,454,954 B2
(45) Date of Patent: Oct. 28, 2025

(54) ROTARY COMPRESSOR AND HOME APPLIANCE INCLUDING SAME

(71) Applicant: SAMSUNG ELECTRONICS CO., LTD., Suwon-si (KR)

(72) Inventors: Joonhyung Kim, Suwon-si (KR); Munseong Kwon, Suwon-si (KR); Jaewoo Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/906,413

(22) Filed: Oct. 4, 2024

(65) Prior Publication Data

US 2025/0027496 A1 Jan. 23, 2025

Related U.S. Application Data

(63) Continuation of application No. PCT/KR2023/003034, filed on Mar. 6, 2023.

(30) Foreign Application Priority Data

Apr. 6, 2022 (KR) ..... 10-2022-0043010

(51) Int. Cl.
*F04C 18/344* (2006.01)
*F25B 31/02* (2006.01)

(52) U.S. Cl.
CPC ..... *F04C 18/3448* (2013.01); *F25B 31/023* (2013.01); *F04C 2240/30* (2013.01)

(58) Field of Classification Search
CPC ..... F04C 18/3448; F04C 2240/30; F04C 18/356; F04C 18/3564; F04C 23/008;
(Continued)

(56) References Cited

U.S. PATENT DOCUMENTS 4,925,378 A 5/1990 Ushiku et al.
6,537,043 B1 3/2003 Chen
(Continued)

FOREIGN PATENT DOCUMENTS

CN 100419270 C 9/2008
CN 111075720 A 4/2020
(Continued)

OTHER PUBLICATIONS

KR20090006203 English Translation (Year: 2009).*
(Continued)

*Primary Examiner* — Jesse S Bogue
(74) *Attorney, Agent, or Firm* — STAAS & HALSEY LLP

(57) ABSTRACT

A rotary compressor includes: a case; a cylinder inside the case and has an internal space, and which includes a rolling piston configured to eccentrically rotate in the internal space, a vane in contact with the rolling piston such that while the vane is in contact with the rolling piston, the internal space of the cylinder is divided into a suction chamber and a compression chamber, a suction port to allow refrigerant to flow to the suction chamber, and a discharge port to allow the refrigerant to be discharged the compression chamber; a drive device that includes a rotation shaft connected to the rolling piston and a motor configured to rotate the rotation shaft; and a valve member that is fixed to a side surface of the vane and selectively opens and closes the discharge port as the vane reciprocates back and forth.

15 Claims, 13 Drawing Sheets

(58) Field of Classification Search
CPC ..... F04C 23/02; F04C 29/00; F04C 29/12; F04C 29/0085; F04C 29/124; F04C 2240/10; F04C 2240/20; F04C 2240/40; F25B 31/023; F25B 31/026; F25B 1/04; F05B 2210/14; F05B 2240/10; F05B 2240/20
See application file for complete search history.

(56) References Cited

U.S. PATENT DOCUMENTS

| | | | | |
|---|---|---|---|---|
| 6,592,346 | B2 | 7/2003 | Bushness | |
| 7,766,636 | B2 * | 8/2010 | Szepesy | F04C 2/46 418/248 |
| 7,798,791 | B2 * | 9/2010 | Byun | F04C 18/3564 418/24 |
| 8,529,235 | B2 * | 9/2013 | Szepesy | F01C 21/0809 418/248 |
| 10,436,199 | B2 | 10/2019 | Morishita et al. | |
| 10,794,187 | B2 * | 10/2020 | Park | F01C 21/0863 |
| 2009/0180907 | A1 | 7/2009 | Ueda et al. | |
| 2009/0180912 | A1 * | 7/2009 | Morozumi | F04C 18/3564 418/229 |

FOREIGN PATENT DOCUMENTS

| | | |
|---|---|---|
| CN | 111075720 B | 8/2021 |
| JP | 2017-115608 | 6/2017 |
| KR | 10-0839957 | 6/2008 |
| KR | 20-2009-0006203 | 6/2009 |
| KR | 10-1954533 | 3/2019 |
| KR | 10-2186604 | 12/2020 |
| KR | 10-2302472 | 9/2021 |

OTHER PUBLICATIONS

International Search Report dated Jun. 14, 2023 issued in PCT Application No. PCT/KR2023/00304.
Written Opinion dated Jun. 14, 2023 issued in PCT Application No. PCT/KR2023/00304.

* cited by examiner

ROTARY COMPRESSOR AND HOME APPLIANCE INCLUDING SAME

CROSS-REFERENCE TO RELATED APPLICATION

This application is a continuation application, under 35 U.S.C. § 111(a), of international application No. PCT/KR2023/003034, filed Mar. 6, 2023, which claims priority under 35 U.S.C. § 119 to Korean Patent Application No. 10-2022-0043010, filed Apr. 6, 2022, the disclosures of which are incorporated herein by reference in their entireties.

BACKGROUND

Technical Field

The disclosure relates to a rotary compressor with improved efficiency as a valve member formed integrally with a vane opens and closes an outlet of a compression chamber, and to a home appliance including the same.

Description of the Related Art

A compressor is a mechanical device that increases pressure by compressing air, refrigerant, or various other working gases using a motor, a turbine, or the like. The compressor may be used in a variety of ways throughout industry. When used in the refrigerant cycle, it may convert low-pressure refrigerant into high-pressure refrigerant and deliver it back to the condenser.

Compressors may be broadly classified into a reciprocating compressor which compresses the refrigerant while the piston reciprocates linearly inside the cylinder by forming a compression space through which the working gas is sucked in and discharged between the piston and the cylinder, a scroll compressor which compresses the refrigerant as the orbiting scroll rotates along the fixed scroll by forming a compression space through which the working gas is sucked in and discharged between the orbiting scroll and the fixed scroll, and a rotary compressor which compresses the refrigerant as the rolling piston rotates eccentrically along the inner wall of the cylinder by forming a compression space through which the working gas is sucked in and discharged between the eccentrically rotating rolling piston and the cylinder.

The rotary compressor according to the prior art includes a vane that divides a compression space into a suction chamber and a compression chamber, and a valve that opens and closes a discharge port of the compression chamber. When the pressure of the compression chamber exceeds a defined value, the valve opens the discharge port of the compression chamber. When the pressure of the compression chamber is less than the defined value, the valve closes the discharge port of the compression chamber.

As the valve unintentionally opens the discharge port of the compression chamber late, overcompression of the refrigerant occurs, which reduces the efficiency of the compressor. In addition, as the valve periodically hits the discharge port, noise is generated and the valve is damaged.

SUMMARY

According to an embodiment of the disclosure, a rotary compressor may include a case; a cylinder inside the case, the cylinder comprising an internal space, a rolling piston configured to eccentrically rotate in the internal space, a vane to be in contact with the rolling piston such that while the vane is in contact with the rolling piston, the internal space of the cylinder is divided into a suction chamber and a compression chamber, a suction port to allow refrigerant to flow to the suction chamber, and a discharge port to allow the refrigerant to be discharged the compression chamber; a drive device comprising a rotation shaft connected to the rolling piston and a motor configured to rotate the rotation shaft; and a valve member, fixed to a side surface of the vane, and configured to selectively open and close the discharge port as the vane reciprocates back and forth.

The valve member may be above the discharge port.

The vane has a first length along a front-back direction of the vane, a front end of the valve member is further back from a front end of the vane by a second length, and the second length may be 0.1 times to 0.5 times the first length.

An upper surface of the valve member may be at a height equal to an upper surface of the vane.

The cylinder may include a vane slot in which the vane is disposed, the vane slot configured to guide a movement path of the vane; and a valve slot in which the valve member is seated, the valve member being moveable in the valve slot with the vane disposed in the vane slot to thereby selectively open and close the discharge port as the vane reciprocates back and forth in the vane slot.

A depth of the valve slot may be equal to a thickness of the valve member.

The vane may include a fastening hole on a side surface thereof, and the valve member may include a fastening protrusion formed on one surface facing the side surface of the vane where the fastening protrusion of the valve member is insertable into the fastening hole of the vane.

The valve member may be fixed to a side surface of the vane facing the discharge port.

The rotary compressor may further include a flange member configured to close the internal space of the cylinder and including a flange hole configured to selectively allow the refrigerant to be discharged through the discharge port of the cylinder. The valve member may be disposed between the discharge port and the flange hole.

The flange member may be a first flange configured to close an upper side of the internal space of the cylinder; and the rotary compressor further includes a second flange configured to close a lower side of the internal space of the cylinder, wherein the flange hole is formed in the first flange.

The valve member may include a plurality of grooves on a lower surface facing the cylinder.

The vane may include a plurality of grooves on the side surface to which the valve member is fixed.

The cylinder may include a plurality of grooves formed on an upper surface facing the valve member.

According to an embodiment of the disclosure, a home appliance that controls temperature through heat exchange using refrigerant may include a rotary compressor. The rotary compressor may include: a case; a cylinder disposed inside the case, the cylinder comprising an internal space, a rolling piston configured to eccentrically rotate in the internal space, a vane to be in contact with the rolling piston such that while the vane is in contact with the rolling piston, the internal space of the cylinder is divided into a suction chamber and a compression chamber, a suction port to allow refrigerant to flow to the suction chamber, and a discharge port to allow the refrigerant to be discharged the compression chamber; a drive device comprising a rotation shaft connected to the rolling piston and a motor configured to rotate the rotation shaft; and a valve member fixed to a side surface of the vane and configured to selectively open and close the discharge port as the vane reciprocates back and forth.

The home appliance may be one of air conditioners, refrigerators, and freezers.

BRIEF DESCRIPTION OF THE DRAWINGS

These and/or other aspects, features, and advantages of certain embodiments of the disclosure will be more apparent from the following description taken in conjunction with the accompanying drawings, in which.

DETAILED DESCRIPTION

Various embodiments described below are shown by way of example to assist understanding of the disclosure, and it should be understood that the disclosure may be variously modified and implemented differently from the embodiments described herein. However, in the following description of the disclosure, when it is determined that a detailed description of a related known function or components may unnecessarily obscure the gist of the disclosure, the detailed description and specific illustration thereof will be omitted. Further, in the accompanying drawings, the dimensions of some components may be arbitrarily exaggerated and not drawn to scale in order to aid understanding of the disclosure.

The terms used in the disclosure and the claims are general terms identified in consideration of the functions of the various embodiments of the disclosure. However, these terms may vary depending on intention, technical interpretation, emergence of new technologies, and the like of those skilled in the related art. Unless there is a specific definition of a term, the term may be understood based on the overall contents and technological understanding of those skilled in the related art.

In this disclosure, the terms such as "have", "may have", "include" or "may include" refer to a presence of the corresponding features (e.g., a numerical value, function, operation, or component such as a part), and does not preclude a presence of additional features.

In the disclosure, components required for the description of each embodiment of the disclosure are described and thus, the embodiment is not necessarily limited thereto. Accordingly, some components may be changed or omitted and other components may be added. In addition, components may be disposed and arranged in different independent devices.

Further, the embodiments of the disclosure will be described in detail with reference to the accompanying drawings and the contents described in the accompanying drawings, but the disclosure is not limited or limited by the embodiments.

One object of the disclosure is to provide a rotary compressor with improved efficiency as a valve member formed integrally with a vane opens and closes a discharge port of a compression chamber, and a home appliance including the same.

Hereinafter, the disclosure will be described in detail with reference to the accompanying drawings.

Figure 1:
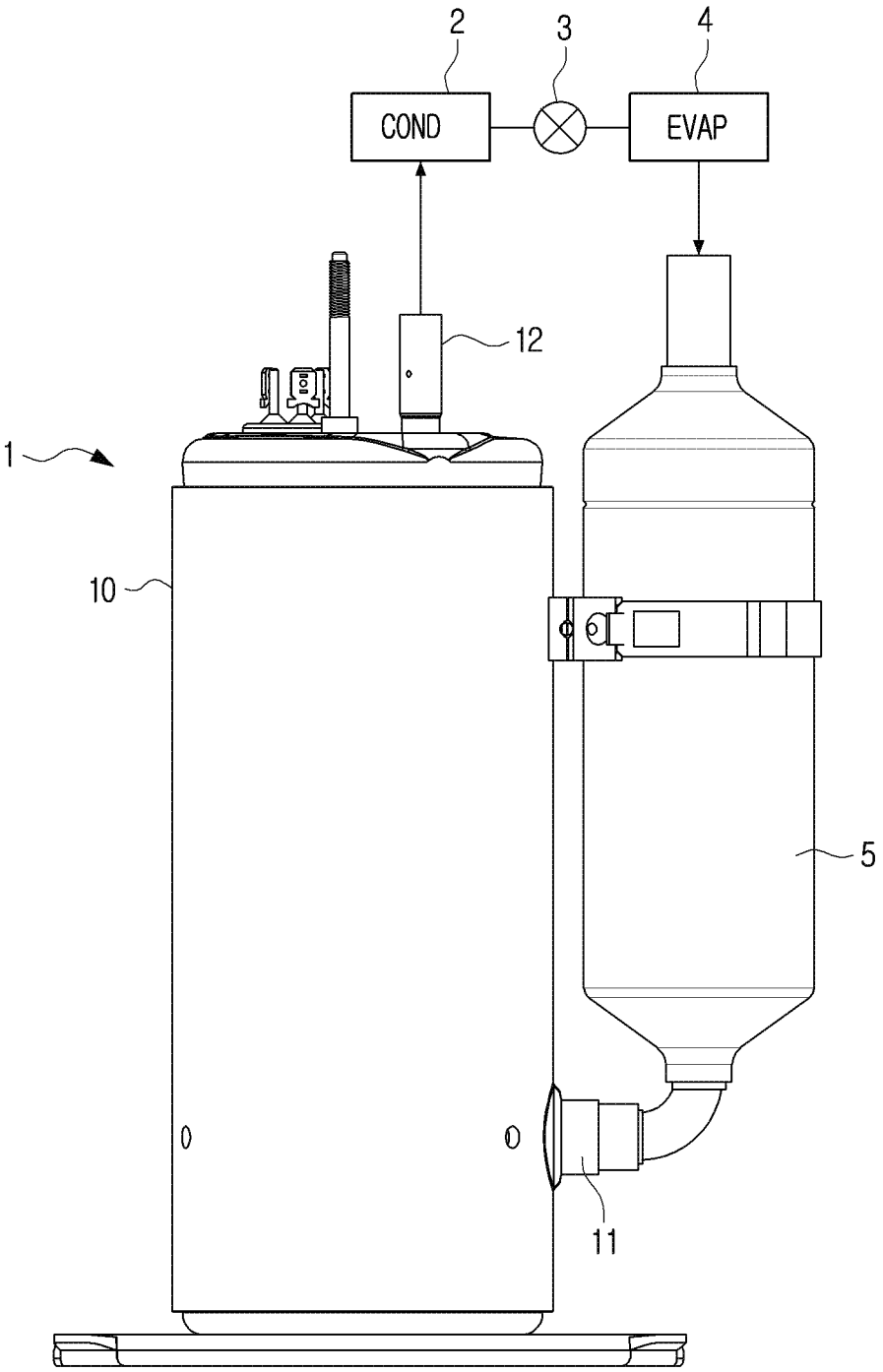
FIG. 1 is a perspective view of a rotary compressor according to an embodiment of the disclosure.
Figure 2:
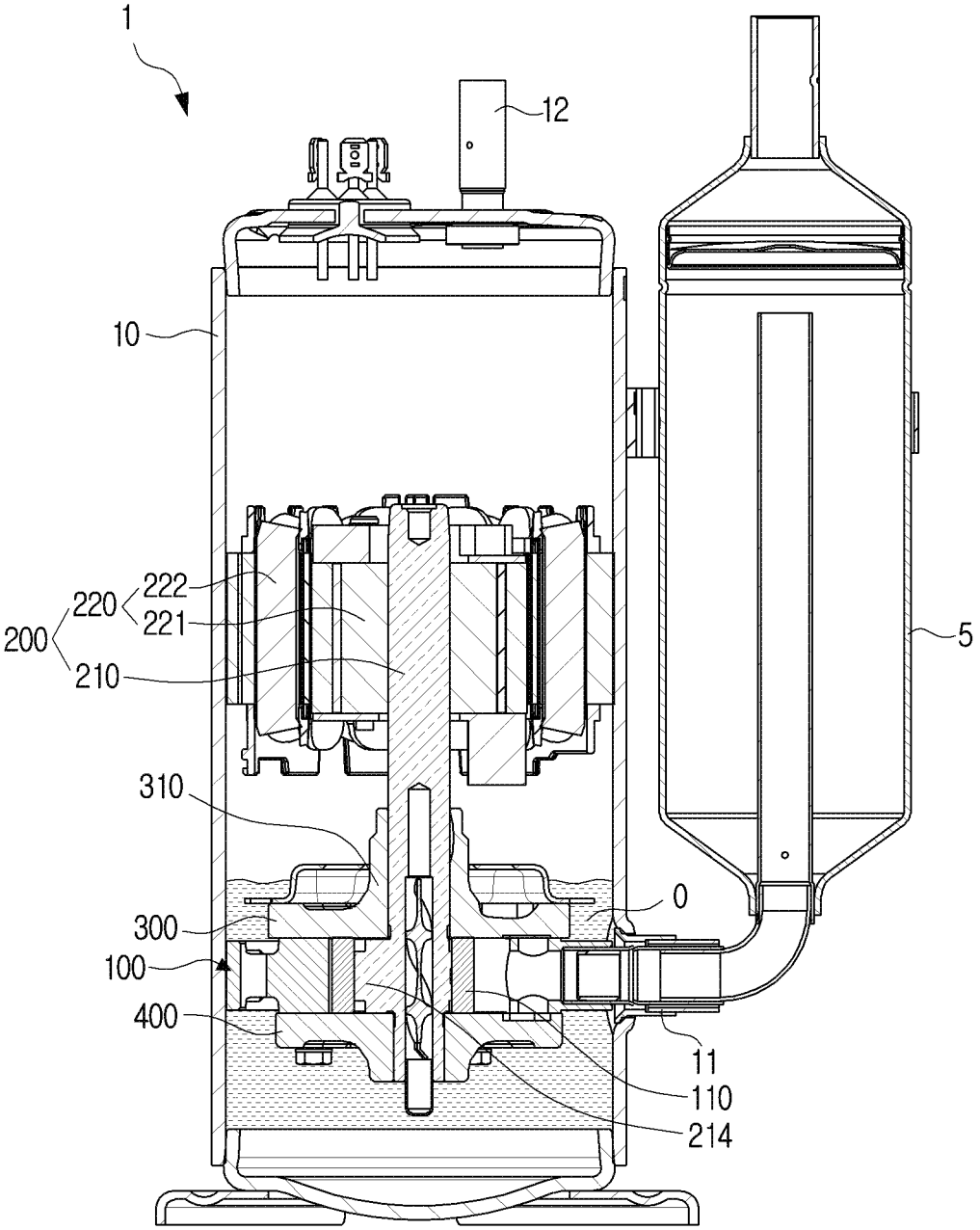
FIG. 2 is a cross-sectional view of a rotary compressor according to an embodiment of the disclosure.
Figure 3:
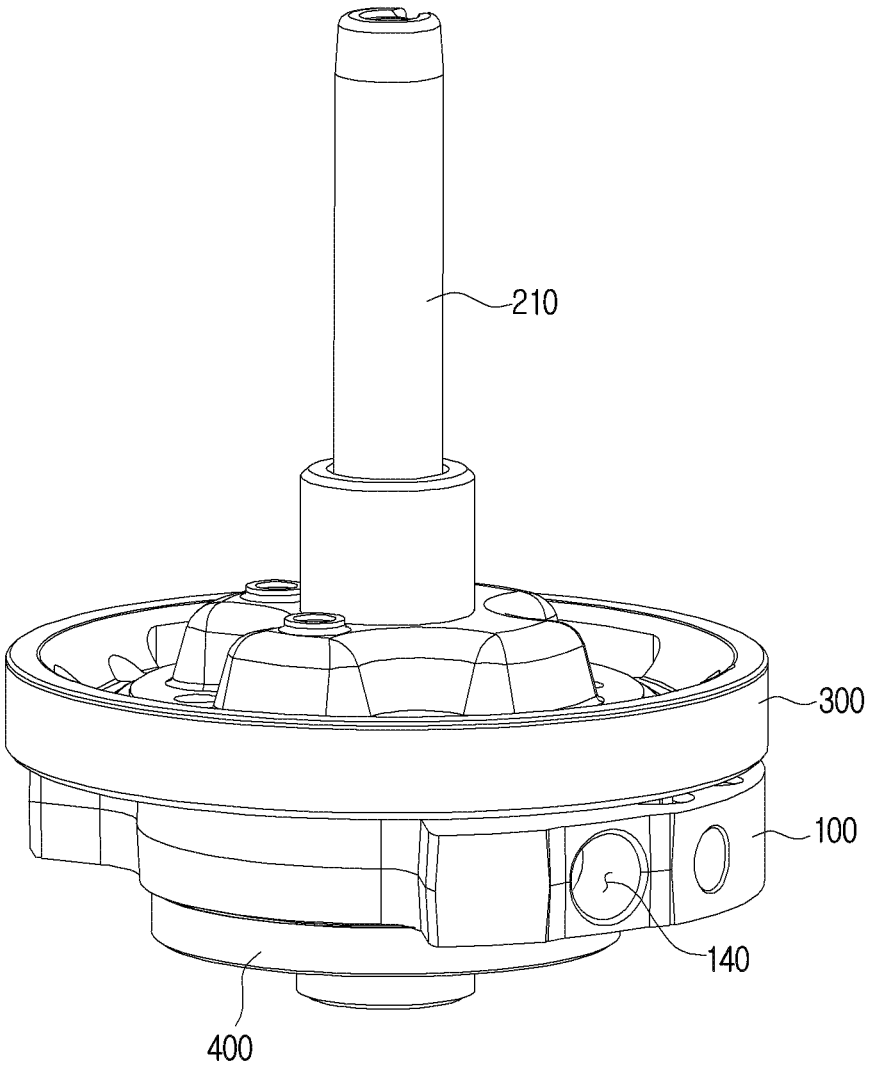
FIG. 3 is a perspective view of a compression part according to an embodiment of the disclosure.

FIG. 1 is a perspective view of a rotary compressor according to an embodiment of the disclosure. FIG. 2 is a cross-sectional view of a rotary compressor according to an embodiment of the disclosure. FIG. 3 is a perspective view of a compression part according to an embodiment of the disclosure.

As illustrated in FIG. 1, a refrigeration cycle has four processes: compression, condensation, expansion, and evaporation. The four processes of compression, condensation, expansion, and evaporation occur as a refrigerant circulates through a rotary compressor 1, a condenser 2, an expansion valve 3, and an evaporator 4.

The rotary compressor 1 compresses and discharges refrigerant gas at high-temperature and high-pressure, and the high-temperature and high-pressure refrigerant gas discharged from the rotary compressor 1 flows into the condenser 2.

In the condenser 2, the refrigerant compressed in the compressor 1 is condensed into a liquid state, and heat is released to the surroundings through the condensation process.

The expansion valve 3 expands the high-temperature and high-pressure refrigerant condensed in the condenser 2 into a low-pressure state. The evaporator 4 evaporates the refrigerant expanded in the expansion valve 3, achieves a refrigeration effect by exchanging heat with an object to be cooled using the latent heat of evaporation, and returns the low-temperature and low-pressure refrigerant gas to the rotary compressor 1. The air temperature in the indoor space may be controlled through this cycle.

In addition, the home appliance equipped with this refrigeration cycle may be one of an air conditioner, refrigerator, or freezer. However, it is not limited to this and may be used in various home appliances equipped with the refrigeration cycle.

The rotary compressor 1 may include an intake port 11 connected to the evaporator 4 to introduce refrigerant from the evaporator 4, and an exhaust port 12 connected to the condenser 2 to discharge the refrigerant compressed at high-temperature and high-pressure in the rotary compressor 1.

An accumulator 5 may be disposed between the intake port 11 of the rotary compressor 1 and the evaporator 4. The accumulator 5 may temporarily accommodate some of the low-temperature and low-pressure refrigerant delivered from the evaporator 4 that does not reach gas and exists in a liquid phase, thereby preventing the liquid refrigerant from flowing into the rotary compressor 1. That is, only liquid refrigerant remains inside the accumulator 5, and gaseous refrigerant may flow into the rotary compressor 1.

The rotary compressor 1 may include a case 10 that forms the exterior, a compression part which is provided inside the case 10 and compresses the refrigerant introduced through the intake port 11, and a drive device 200 which is provided inside the case and connected to the compression part to drive the compression part. The case 10 may have oil O stored in its lower portion.

The compression part may include a cylinder 100, a first flange 300, and a second flange 400. The cylinder 100 may be disposed inside the case 10 and compress the refrigerant. The first flange 300 may be disposed at the upper side of the cylinder 100, and the second flange 400 may be disposed at the lower side of the cylinder 100. The detailed structure of the compression part will be described later.

The drive device 200 may include a rotation shaft 210 and a motor 220. The rotation shaft 210 may be connected to a rolling piston 110. The motor 220 may rotate the rotation shaft 210. The motor 220 may include a stator 222 fixed to the inner surface of the case 10 and a rotor 221 rotatably disposed inside the stator 222. The rotation shaft 210 may be provided to rotate together with the rotor 221 inside the rotor 221.

The rotation shaft 210 is connected to the compression part and rotates the rolling piston 110 of the compression part to compress the refrigerant introduced into the compression part. An eccentric portion 214 may be disposed between the rotation shaft 210 and the rolling piston 110.

Accordingly, the drive device 200 is connected to the compression part through the rotation shaft 210, and may transmit power to the compression part.

Figure 4:
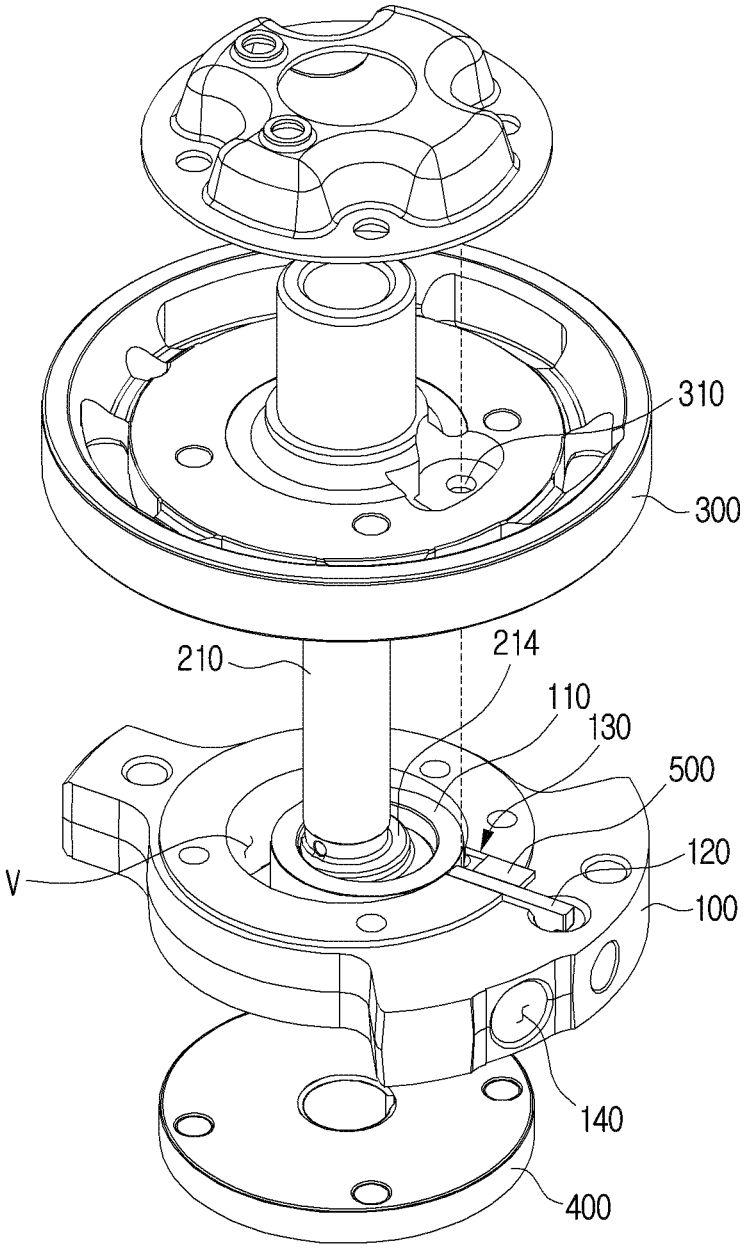
FIGS. 4 and 5 are exploded perspective views of the compression part illustrated in FIG. 3 according to an embodiment of the disclosure.
Figure 5:
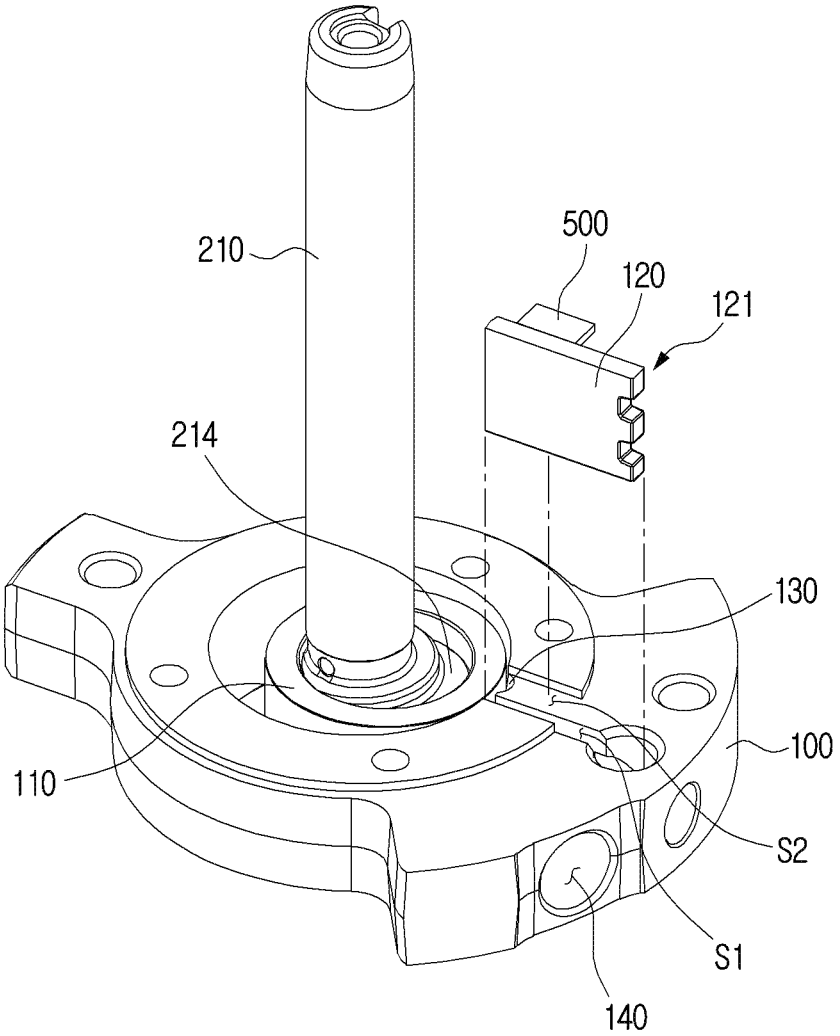

FIGS. 4 and 5 are exploded perspective views of the compression part illustrated in FIG. 3.

Referring to FIGS. 4 and 5, the cylinder 100 has an internal space V and may include a rolling piston 110, a vane 120, a suction port 140, and a discharge port 130.

The rolling piston 110 may rotate eccentrically in the internal space V of the cylinder 100. The vane 120 may be in contact with the rolling piston 110 and divide the internal space V of the cylinder 100 into a suction chamber V1 (see FIG. 7) and a compression chamber V2 (see FIG. 7). The suction port 140 may communicate with the suction chamber V1, and the discharge port 130 may communicate with the compression chamber V2.

The suction port 140 may be formed to penetrate the cylinder 100 in a radial direction from the side surface of the cylinder 100. One end of the suction port 140 may communicate with the outside of the cylinder 100, and the other end of the suction port 140 may communicate with the suction chamber V1.

The discharge port 130 may have the shape of a groove formed from the inner surface of the compression chamber V2 to the upper surface of the cylinder 100. The discharge port 130 may be disposed adjacent to the vane 120. The refrigerant compressed in the compression chamber V2 may rise along the discharge port 130.

The refrigerant may flow into the suction chamber V1 of the cylinder 100 through the suction port 140 of the cylinder 100, be compressed according to the turning movement of the rolling piston 110, and then be discharged from the compression chamber V2 to the outside of the cylinder 100 through the discharge port 130.

The rear end of the vane 120 is connected to an elastic member (not illustrated), and the elastic member may press the vane 120 forward. Accordingly, the front end of the vane 120 is always in contact with the rolling piston 110, and the vane 120 may reciprocate linearly forward and backward by the turning movement of the rolling piston 110.

The cylinder 100 may include a vane slot S1 formed long along the radial direction. The vane 120 may be disposed inside the vane slot S1, the movement path of the vane 120 may be guided by the vane slot S1.

The rotary compressor 1 may include a valve member 500. The valve member 500 is fixed to a side surface 121 of the vane 120, and may selectively open and close the discharge port 130 as the vane 120 reciprocate back and forth.

The valve member 500 may have a substantially rectangular parallelepiped shape, but is not limited thereto. The valve member 500 may have any shape as long as it can cover the upper side of the discharge port 130. The valve member 500 may have a larger cross-section than the discharge port 130.

During the compression process, when the rolling piston 110 rotates and the vane 120 advances more than a defined value, the valve member 500 may advance integrally with the vane 120 to close the upper side of the discharge port 130.

At the end of the compression process, when the rolling piston 110 rotates further and the vane 120 moves backward greater than a defined value, the valve member 500 may move backwards integrally with the vane 120. At this time, the discharge port 130 is opened by the valve member 500 so that the compressed refrigerant may be discharged from the compression chamber V2.

The valve member 500 may be disposed above the discharge port 130. In other words, the valve member 500 may selectively open and close the discharge port 130 while sliding on the upper side of the discharge port 130.

The valve member 500 may be fixed to the side surface 121 of the vane 120 facing the discharge port 130. That is, the valve member 500 is fixed to the side surface 121 of the vane 120 and may periodically move forward and backward together with the vane 120.

The rotary compressor 1 may further include flange members 300 and 400. The flange members 300 and 400 close the internal space V of the cylinder 100 and may include a flange hole 310 that selectively communicates with the discharge port 130 of the cylinder 100. The flange hole 310 may be formed on the same axis as the discharge port 130.

The valve member 500 may be disposed between the discharge port 130 and the flange hole 310. That is, the valve member 500 may reciprocate back and forth between the discharge port 130 and the flange hole 310 and allow the discharge port 130 to selectively communicate with the flange hole 310.

When the vane 120 and the valve member 500 are sufficiently moved backward, the discharge port 130 is opened, so that the compressed refrigerant may be discharged to the outside of the compression part through the discharge port 130 and the flange hole 310.

The flange members 300 and 400 may include a first flange 300 that closes the upper side of the internal space V of the cylinder 100 and a second flange 400 that closes the lower side of the internal space V of the cylinder 100. In addition, the flange hole 310 described above may be formed in the first flange 300.

A muffler 13 may be provided on the upper side of the first flange 300 to reduce noise of the refrigerant gas that is compressed inside the cylinder 100 and sequentially passes through the discharge port 130 and the flange hole 310.

The cylinder 100 may include a vane slot S1 and a valve slot S2. The vane slot S1 is where the vane 120 is placed and may guide the movement path of the vane 120.

The valve slot S2 communicates with the vane slot S1 and the discharge port 130, and the valve member 500 may be seated on the valve slot S2. The valve slot S2 may be formed so that an area of the upper surface of the cylinder 100 corresponding to the valve member 500 is concave to a defined depth.

The depth of the valve slot S2 may be the same as the thickness of the valve member 500. The depth of the valve slot S2 and the thickness of the valve member 500 may be measured in the vertical direction. That is, the lower surface of the valve member 500 may be in contact with the area of the upper surface of the cylinder 100 corresponding to the valve slot S2, and the upper surface of the valve member 500 may be disposed at the same height as an area in which the valve slot S2 is not formed on the upper surface of the cylinder 100. That is, the upper surface of the valve member 500 and the area of the upper surface of the cylinder 100 in which the valve slot S2 is not formed may be disposed on the same horizontal plane.

Accordingly, it is possible to prevent the refrigerant from unintentionally leaking through the gap between the valve member 500 and the cylinder 100, thereby reducing compression efficiency.

The upper surface of the valve member 500 may be disposed at the same height as the upper surface of the vane 120. That is, the upper surface of the valve member 500 and the upper surface of the vane 120 may be disposed on the same horizontal plane.

Accordingly, it is possible to prevent the refrigerant from unintentionally leaking through the gap between the valve member 500 and the first flange 300, thereby reducing compression efficiency.

FIGS. 6 to 9 are top views illustrating a position of a valve member according to rotation of a rotation shaft. FIGS. 6 to 9 may be views illustrating states in which the rotation shaft 210 and the rolling piston 110 are rotated by 0 degrees (or 360 degrees), 90 degrees, 180 degrees, and 270 degrees, respectively. The rotation shaft 210 and the rolling piston 110 may rotate clockwise.

Referring to FIGS. 6 to 9, as the eccentric portion 214 of the rotation shaft 210 rotates in an internal contact with the rolling piston 110, the rolling piston 110 may rotate with eccentricity. As described above, the rear end of the vane 120 is pressed toward the front, so the front end 122 of the vane 120 is always in contact with the rolling piston 110, and thus the vane 120 may reciprocate linearly back and forth by the rotating movement of the rolling piston 110.

Figure 6:
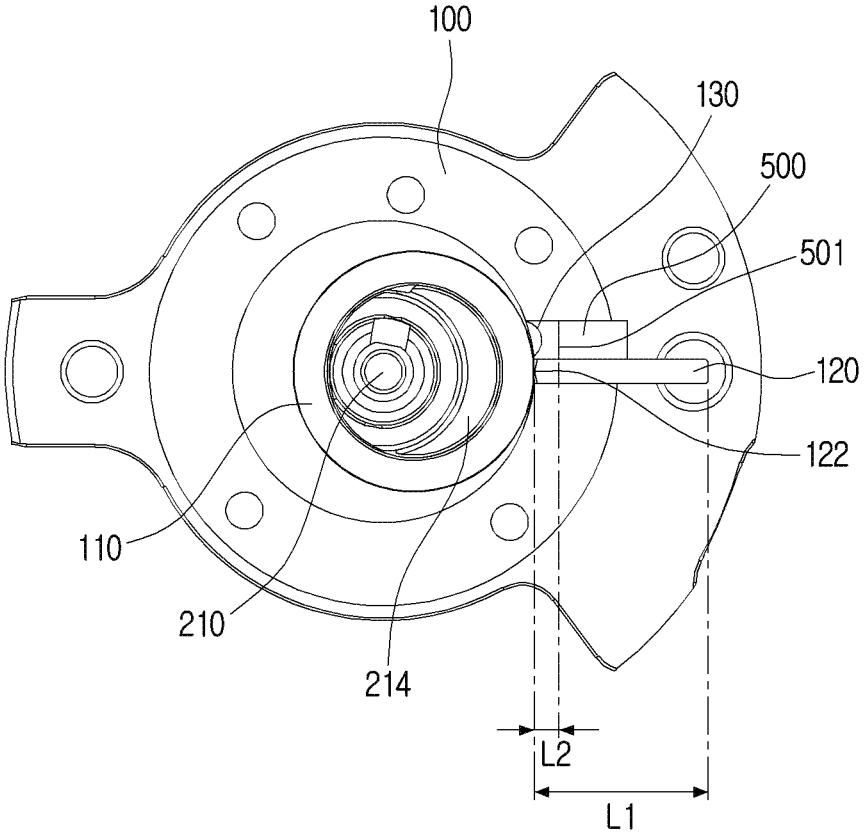
FIGS. 6, 7, 8 to 9 are top views illustrating a position of a valve member according to rotation of a rotation shaft according to an embodiment of the disclosure.
Figure 7:
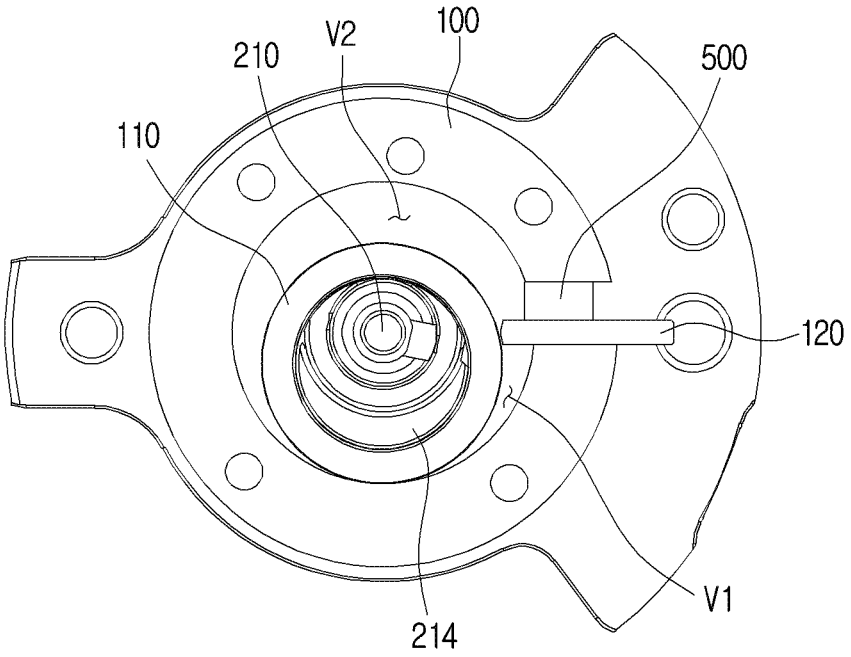
Figure 8:
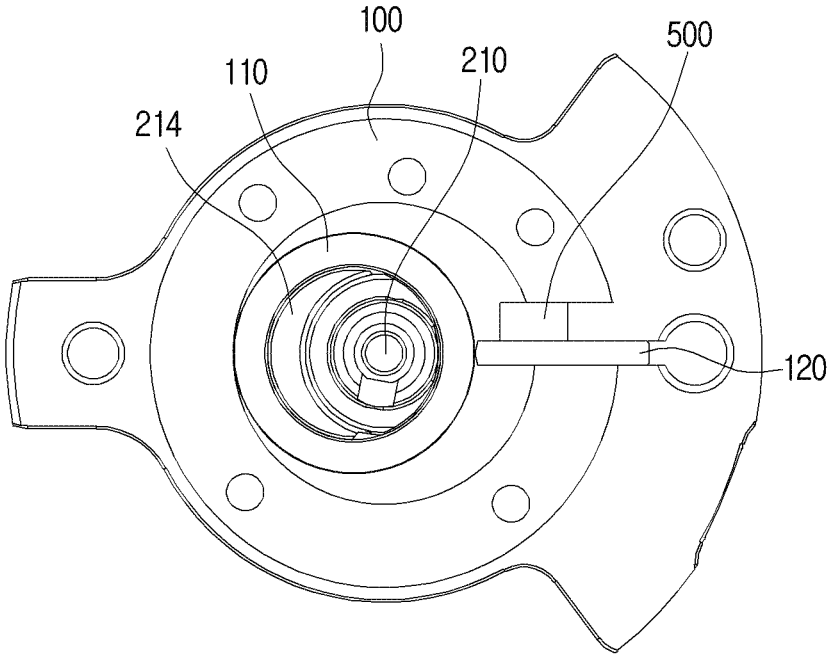

Looking at FIGS. 6 to 8 in order, as the rotation shaft 210 and the rolling piston 110 rotate from 0 degrees to 180 degrees, the vane 120 and the valve member 500 may advance toward the rotation shaft 210.

Figure 9:
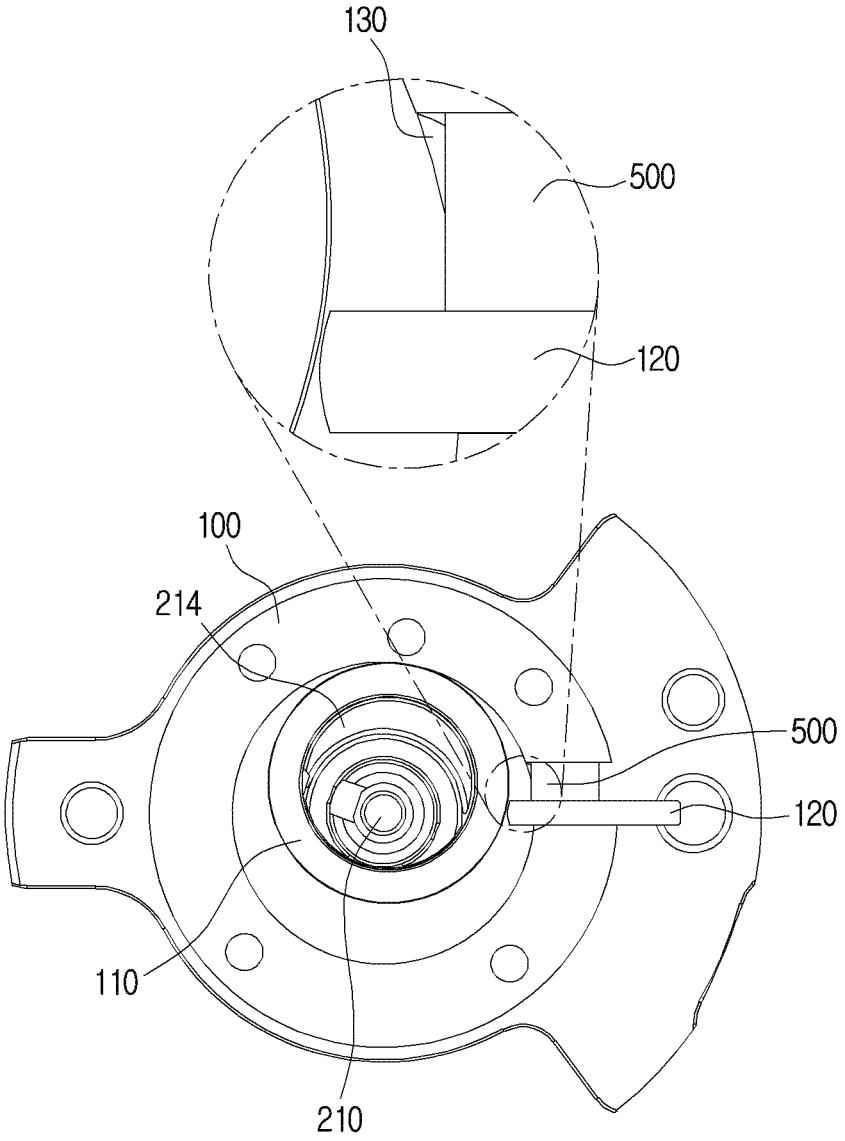

Looking at FIGS. 8, 9, and 6 in order, as the rotation shaft 210 and the rolling piston 110 rotate from 180 degrees to 0 degrees, the vane 120 and the valve member 500 may move backward in a direction away from the rotation shaft 210.

For example, when the rotation shaft 210 and the rolling piston 110 rotate from 90 degrees to 270 degrees, the valve member 500 may close the discharge port 130. For example, when the rotation shaft 210 and the rolling piston 110 rotate from 270 degrees to 90 degrees, the valve member 500 may open the discharge port 130. However, the above-described critical rotational angles are an example and may vary depending on the position of the valve member 500.

The vane 120 may have a first length L1 along the front-back direction. The front end 501 of the valve member 500 may be disposed rearward than the front end 122 of the vane 120 by a second length L2. As the second length L2 increases, the discharge port 130 may be opened sooner. As the second length L2 decreases, the discharge port 130 may be opened later.

The second length L2 may be 0.1 times to 0.5 times the first length L1. Accordingly, because the discharge port 130 is opened after the refrigerant is sufficiently compressed to the target pressure and before overcompression, the compression efficiency of the rotary compressor 1 may be increased.

Figure 10:
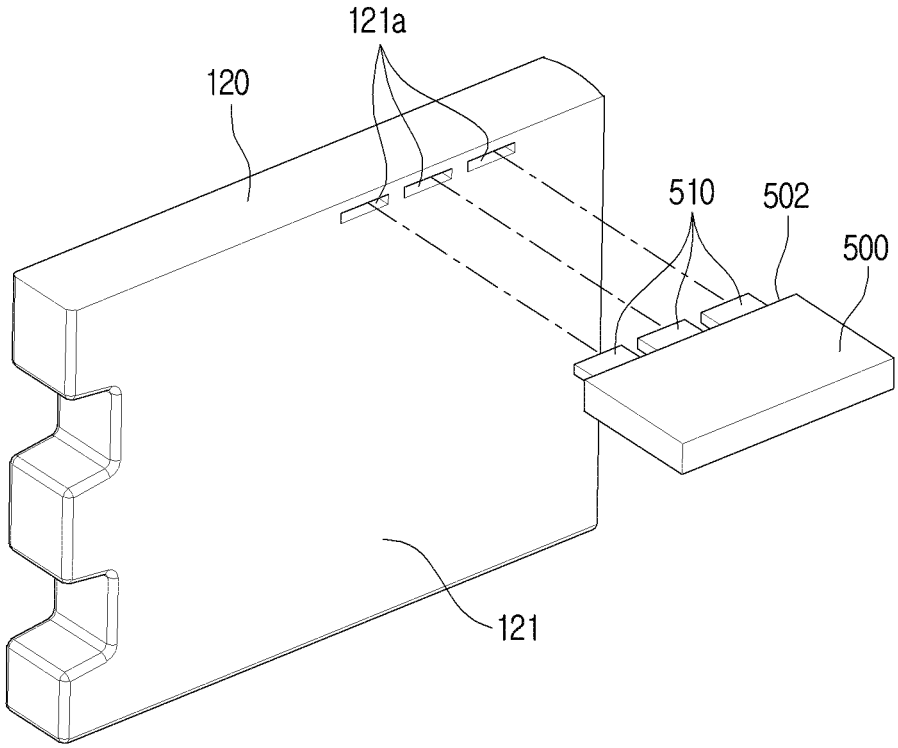
FIG. 10 is a perspective view illustrating a fastening structure of a vane and a valve member according to an embodiment of the disclosure.

FIG. 10 is a perspective view illustrating a fastening structure of a vane and a valve member. Referring to FIG. 10, the vane 120 may include a fastening hole 121*a*, and the valve member 500 may include a fastening protrusion 510. The fastening hole 121*a* and the fastening protrusion 510 may be formed in plural numbers, and may be formed in the same number.

The fastening hole 121*a* may be formed on the side surface 121 of the vane 120. The fastening protrusion 510 may be formed on one surface 502 of the valve member 500 facing the side surface 121 of the vane 120 and inserted into the fastening hole 121*a*. Accordingly, the vane 120 and the valve member 500 may be stably fastened to each other.

Figure 11:
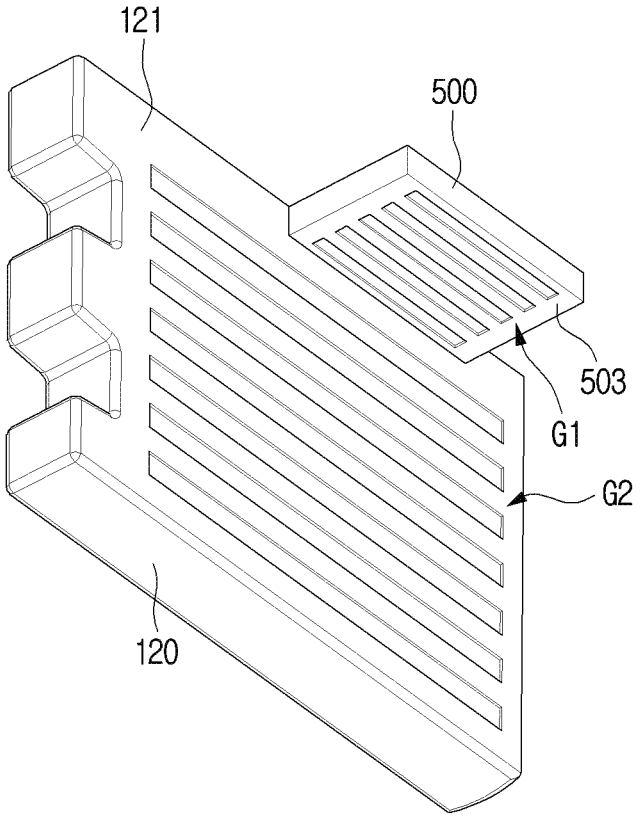
FIG. 11 is a perspective view illustrating grooves formed in a vane and a valve member according to an embodiment of the disclosure.

FIG. 11 is a perspective view illustrating grooves formed in a vane and a valve member.

Referring to FIG. 11, at least one of the valve member 500 and the vane 120 may include a plurality of grooves on one surface thereof.

The valve member 500 may have a plurality of grooves G1 formed on the lower surface 503 facing the cylinder 100. The plurality of grooves G1 may be formed by grooving one area of the lower surface 503 of the valve member 500 upward. The plurality of grooves G1 may be formed parallel to each other along the front-back direction.

The lower surface 503 of the valve member 500 may slide back and forth while contacting the upper surface of the cylinder 100. That is, the contact area between the valve member 500 and the cylinder 100 may be reduced by the plurality of grooves G1, thereby reducing friction loss. In addition, by filling the plurality of grooves G1 with oil, it is possible to prevent the refrigerant from unintentionally leaking to the outside through a gap between the valve member 500 and the cylinder 100.

The vane 120 may have a plurality of grooves G2 formed on the side surface 121 to which the valve member 500 is fixed. The plurality of grooves G2 may be formed by grooving one area of the side surface 121 of the vane 120. The plurality of grooves G2 may be formed parallel to each other along the front-back direction.

The side surface 121 of the vane 120 may slide back and forth while contacting the inner surface of the cylinder 100 corresponding to the vane slot S1. That is, the contact area between the vane 120 and the cylinder 100 may be reduced by the plurality of grooves G2, thereby reducing friction loss. In addition, by filling the plurality of grooves G2 with oil, it is possible to prevent the refrigerant from unintentionally leaking to the outside through a gap between the vane 120 and the cylinder 100.

Figure 12:
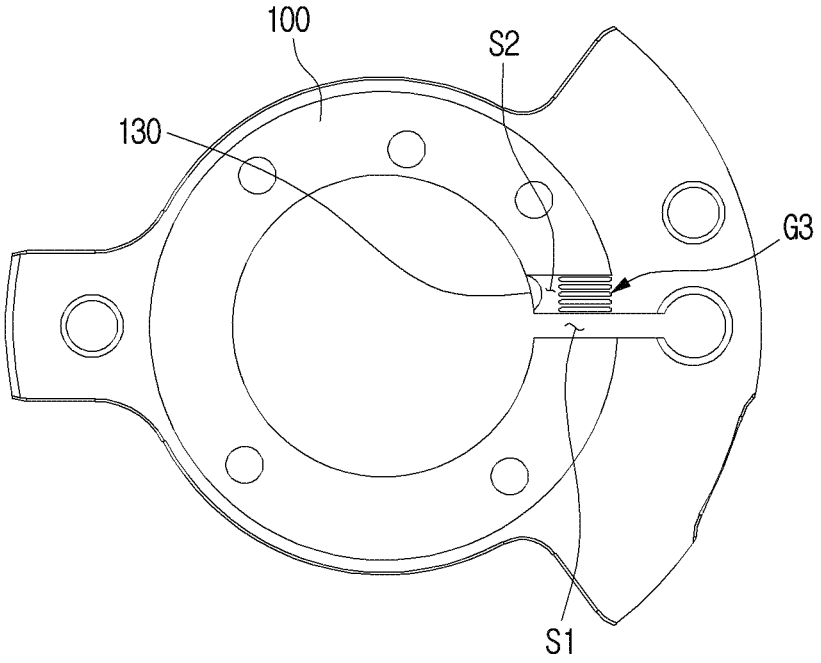
FIG. 12 is a view illustrating a groove formed in a cylinder according to an embodiment of the disclosure.

FIG. 12 is a view illustrating a groove formed in a cylinder.

Referring to FIG. 12, a plurality of grooves G3 may be formed on the upper surface of the cylinder 100 facing the valve member 500. The plurality of grooves G3 may be formed by grooving the area of the upper surface of the cylinder 100 corresponding to the valve slot S2 downward. The plurality of grooves G3 may be formed parallel to each other along the front-back direction.

The valve member 500 may slide back and forth while contacting the upper surface of the cylinder 100. That is, the contact area between the valve member 500 and the cylinder 100 may be reduced by the plurality of grooves G3, thereby reducing friction loss. In addition, by filling the plurality of grooves G3 with oil, it is possible to prevent the refrigerant from unintentionally leaking to the outside through the gap between the valve member 500 and the cylinder 100.

Figure 13:
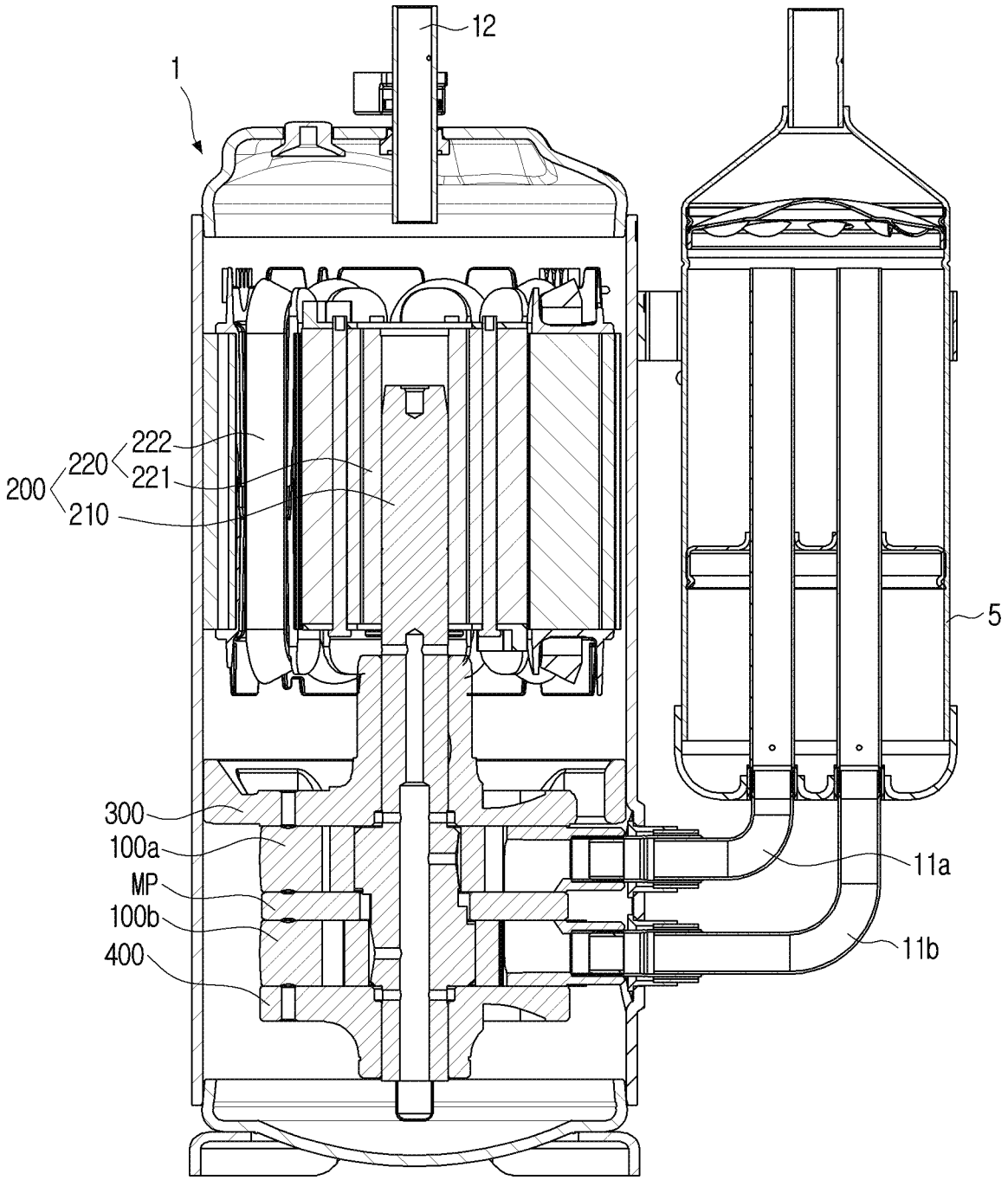
FIG. 13 is a cross-sectional view of a rotary compressor with a twin cylinder structure according to an embodiment of the disclosure.

FIG. 13 is a cross-sectional view of a rotary compressor with a twin cylinder structure. Referring to FIG. 13, a rotary compressor 1 according to an embodiment of the disclosure may have a twin cylinder structure.

The rotary compressor 1 of FIG. 13 may have a structure in which one cylinder is added to the single cylinder structure of FIG. 2. Among the configurations of the rotary compressor 1 in FIG. 13, descriptions of the same contents as described above may be omitted.

The rotary compressor 1 may include a first cylinder 100*a*, a second cylinder 100*b*, a drive device 200, a first flange 300, a second flange 400, and a middle plate MP. The rotary compressor 1 may include intake ports 11*a*, 11*b* to introduce refrigerant and an exhaust port 12 to discharge the refrigerant compressed at high-temperature and high-pressure in the rotary compressor 1.

The first flange 300 may be disposed on the upper side of the first cylinder 100*a*. The first flange 300 may guide the compressed refrigerant from the internal spaces of the first and second cylinders 100*a* and 100*b* to the exhaust port 12.

The first and second cylinders 100*a* and 100*b* may be arranged vertically, and the middle plate MP may be arranged between the first cylinder 100*a* and the second cylinder 100*b*.

The rolling piston of the first cylinder 100*a* and the rolling piston of the second cylinder 100*b* may rotate eccentrically to have a phase difference of 180 degrees in the rotation direction of the rotation shaft 210.

The first flange 300, the first cylinder 100*a*, and the middle plate MP may form the internal space of the first cylinder 100*a*. In addition, the second flange 400, the second cylinder 100*b*, and the middle plate MP may form the internal space of the second cylinder 100*b*.

The refrigerant compressed in the first cylinder 100*a* may be discharged upward through the first flange 300, and the refrigerant compressed in the second cylinder 100*b* may be discharged upward through the middle plate MP, the first cylinder 100*a*, and the first flange 300.

Each of the first and second cylinders 100*a* and 100*b* may include a valve member that moves back and forth integrally with the vane to open and close the discharge port. That is, the valve member of the first cylinder 100*a* may exposes the internal space of the first cylinder 100*a* upward, and the valve member of the second cylinder 100*b* may expose the internal space of the second cylinder 100*b* downward.

Accordingly, in the rotary compressor 1 having a twin cylinder structure, the two valve members open the discharge ports of the first and second cylinders 100*a* and 100*b* at the correct time, respectively, so the overcompression of the refrigerant does not occur and the compression efficiency may be increased.

The rotary compressor 1 according to an embodiment of the disclosure may solve the problems of noise being generated and the valve being damaged as the valve according to the prior art periodically hits the discharge port, and may improve the efficiency by allowing the valve member formed integrally with the vane to open and close the discharge port of the compression chamber.

In the above, preferred embodiments of the disclosure have been shown and described, but the disclosure is not limited to the specific embodiments described above. The disclosure may be modified and implemented by anyone skilled in the art without departing from the gist of the disclosure as claimed in the claims, and such changes are within the scope of the claims.

What is claimed is:

1. A rotary compressor comprising:

a case;

a cylinder inside the case, the cylinder including:

an internal space, a rolling piston configured to eccentrically rotate in the internal space, a vane configured to reciprocate in contact with the rolling piston such that the vane and rolling piston together are configured to divide the internal space of the cylinder into a suction chamber and a compression chamber, a suction port to allow low pressure refrigerant to flow to the suction chamber, and a discharge port to allow high pressure refrigerant to be discharged from the compression chamber;

a drive device including a rotation shaft connected to the rolling piston and a motor configured to rotate the rotation shaft to eccentrically rotate the rolling piston; and a valve member, fixed to a side surface of the vane, configured to close the discharge port while the low pressure refrigerant is being compressed in the compression chamber and open the discharge port to discharge the high pressure refrigerant from the compression chamber as the vane reciprocates back and forth.

2. The rotary compressor of claim 1, wherein the valve member is above the discharge port.

3. The rotary compressor of claim 1, wherein the vane has a first length along a front-back direction of the vane, and a front end of the valve member is further back from a front end of the vane by a second length, and the second length is 0.1 times to 0.5 times the first length.

4. The rotary compressor of claim 1, wherein an upper surface of the valve member is at a height equal to an upper surface of the vane.

5. The rotary compressor of claim 1, wherein the cylinder comprises:

a vane slot configured to guide the reciprocation of the vane; and a valve slot in which the valve member is seated, the valve member being moveable in the valve slot with the reciprocation of the vane in the vane slot to close the discharge port while the low pressure refrigerant is being compressed and open the discharge port to discharge the high pressure refrigerant as the vane reciprocates back and forth in the vane slot.

6. The rotary compressor of claim 5, wherein a depth of the valve slot is equal to a thickness of the valve member.

7. The rotary compressor of claim 1, wherein the vane includes a fastening hole on a side surface thereof, and the valve member includes a fastening protrusion on one surface facing the side surface of the vane where the fastening protrusion of the valve member is insertable into the fastening hole of the vane.

8. The rotary compressor of claim 1, wherein the valve member is fixed to a side surface of the vane facing the discharge port.

9. The rotary compressor of claim 1, further comprising:

a flange member configured to close the internal space of the cylinder and including a flange hole configured to allow the high pressure refrigerant to be discharged through the discharge port of the cylinder with movement of the valve member, wherein the valve member is between the discharge port and the flange hole.

10. The rotary compressor of claim 9, wherein the flange member is a first flange configured to close an upper side of the internal space of the cylinder; and the rotary compressor further includes a second flange configured to close a lower side of the internal space of the cylinder.

11. The rotary compressor of claim 1, wherein the valve member includes a plurality of grooves on a lower surface facing the cylinder.

12. The rotary compressor of claim 1, wherein the vane includes a plurality of grooves on the side surface to which the valve member is fixed.

13. The rotary compressor of claim 1, wherein the cylinder includes a plurality of grooves on an upper surface facing the valve member.

14. A home appliance comprising:

a rotary compressor including:

a case;

a cylinder inside the case, the cylinder including an internal space, a rolling piston configured to eccentrically rotate in the internal space, a vane configured to reciprocate in contact with the rolling piston such that the vane and rolling piston together are configured to divide the internal space of the cylinder into a suction chamber and a compression chamber, a suction port to allow low pressure refrigerant to flow to the suction chamber, and a discharge port to allow high pressure refrigerant to be discharged the compression chamber;

a drive device including a rotation shaft connected to the rolling piston and a motor configured to rotate the rotation shaft to eccentrically rotate the rolling piston; and a valve member, fixed to a side surface of the vane, and configured to close the discharge port while the low pressure refrigerant is being compressed in the compression chamber and open the discharge port to discharge the high pressure refrigerant from the compression chamber as the vane reciprocates back and forth, wherein the home appliance is configured to control temperature through heat exchange using refrigerant.

15. The home appliance of claim 14, wherein the home appliance is one of an air conditioner, a refrigerator, and a freezer.

* * * * *